US008297167B2

(12) United States Patent
Hoffman

(10) Patent No.: US 8,297,167 B2
(45) Date of Patent: Oct. 30, 2012

(54) RECIPROCALLY-CYCLED, EXTERNALLY-ACTUATED WEAPON

(75) Inventor: Brian Hoffman, Bangor, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 347 days.

(21) Appl. No.: 12/607,393

(22) Filed: Oct. 28, 2009

(65) Prior Publication Data

US 2010/0175547 A1 Jul. 15, 2010

Related U.S. Application Data

(60) Provisional application No. 61/116,746, filed on Nov. 21, 2008, provisional application No. 61/177,797, filed on May 13, 2009.

(51) Int. Cl.
*F41A 7/10* (2006.01)

(52) U.S. Cl. ..... 89/11; 89/1.4; 89/27.3

(58) Field of Classification Search ..... 89/9, 11, 89/1.4, 27.3
See application file for complete search history.

(56) References Cited

U.S. PATENT DOCUMENTS

| | | | | |
|---|---|---|---|---|
| 3,302,523 | A * | 2/1967 | Adams et al. | 89/7 |
| 3,645,165 | A * | 2/1972 | Wohlford | 89/11 |
| 4,154,142 | A * | 5/1979 | Schwegler | 89/11 |
| 4,167,888 | A * | 9/1979 | Pechamat et al. | 89/11 |
| 5,392,685 | A * | 2/1995 | Stoner | 89/9 |

* cited by examiner

*Primary Examiner* — Daniel Troy
(74) *Attorney, Agent, or Firm* — Michael C. Sachs

(57) ABSTRACT

A reciprocally-cycled, externally-powered weapon may include a rotative driver connected via a crank and connecting rod to the operating group of the weapon. The connecting rod may be connected to a pinion that meshes with a translating rack and a stationary rack. The translating rack may be connected to the operating group, and the stationary rack may be fixed to the receiver of the weapon. The energy needed to fire the weapon may be supplied by an energy generator. The minimum amount of energy supplied by the energy generator may be independent of the speed of translation of the operating group and may be sufficient to reliably result in cartridge ignition, thereby providing an infinitely adjustable firing rate.

1 Claim, 19 Drawing Sheets

RECIPROCALLY-CYCLED, EXTERNALLY-ACTUATED WEAPON

CROSS-REFERENCE TO RELATED APPLICATIONS

This application claims the benefit under 35 USC 119(e) of U.S. provisional patent application 61/116,746 filed on Nov. 21, 2008, and U.S. provisional patent application 61/177,797 filed on May 13, 2009, both of which are hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates, in general, to weapons and, in particular, to reciprocally cycled, externally-actuated weapons.

Reciprocally-cycled weapons may be classified as self-powered or externally-powered. Self-powered weapons, such as those that rely on recoil or gas for operation, may use the high pressure gases developed during cartridge firing to directly or indirectly cycle the mechanisms that perform certain actions. These actions may include cartridge stripping, cartridge feeding, cartridge chambering, bolt locking, cartridge firing, bolt unlocking, cartridge case extraction, cartridge case ejection, and cartridge indexing.

The reliability of self-powered weapons may depend on successful ignition of the cartridge to generate the high pressure gases needed to cycle the weapon. The weapon may be cycled directly (gas-operated), or indirectly (recoil-operated) via the momentum of the fired projectile. A misfire, where the primer is hit but does not ignite the main propellant charge, may result in a malfunction that requires user intervention to extract the unfired cartridge from the chamber of the weapon. With externally-powered weapons, however, a misfire may not stop the continued operation of the weapon and may not result in any down time of the weapon.

Self-powered weapons may be more portable (i.e. lightweight) or mobile than externally-powered weapons because externally-powered weapons may have operating mechanisms driven by actuators that do not rely on the firing forces of the weapon.

Conventional remote weapon systems (RWS), including remotely-controlled weapon turrets, may utilize conventional self-powered weapons that were designed and developed for manned operation. For example, the U.S. military Common Remotely Operated Weapon System (CROWS) may use conventional man-operated, self-powered machine guns, which are removably mounted in the gun system. Conventional self-powered weapons may periodically encounter malfunctions that require human intervention to correct. When clearing the malfunction and/or reloading a weapon, the human may be exposed to danger from enemy fire.

Conventional self-powered weapons may require an initial, manual charging procedure, manual loading of the ammunition belt, and may be inherently less reliable because of dependence on successful firing of the cartridge. Ammunition malfunctions may often need to be manually cleared before the weapon can resume function. Additionally, these manned weapons may require remote actuation of the safe/arm switch and the trigger when used in conventional RWS applications. The remote actuation may require complex mechanisms and high powered actuators to mimic manual operation. The need for precise and reliable functioning and timing of the safe/arm switch and the trigger may impose an immense burden on RWS designers and the systems they produce. Also, these weapons may be mounted using loose quick-release pins, which may affect the weapon's performance characteristics, such as accuracy and dispersion.

Other RWS designs may use existing weapons that are not self-powered, but, on the other hand, the weapons that are not self-powered may not provide the low inertial properties that may be required. Further, RWS designs using conventional self-powered weapons may not be immediately compatible with a variety of types of ammunition that produce significantly different impulse levels when fired. Additionally, RWS designs using either self-powered or externally-powered weapons may not be capable of being rapidly reloaded either remotely or robotically. For example, a conventional RWS may use an ammunition "can" mounted to the RWS structure, or a magazine which feeds ammunition to the weapon via a chute. Neither of these conventional approaches allows the use of multiple ammunition types of a given caliber, or is capable of the unmanned reloading and malfunction clearing required for robotic, remote applications.

Manually operated RWS may be required to have a quick-dismount feature so an operator may remove the weapon to prevent theft and/or commandeering of the weapon by the enemy. The quick-dismount feature, in addition to the external ammunition stowage, may render the weapon and ammunition of conventional RWS vulnerable to theft, when used on a robotic platform. Thus, conventional RWS may not be suitable for most robotic applications because operation of the conventional RWS may require an on-the-spot human operator. These robotic applications may include the remote placement of gun turrets at, for example, roadblocks, or on robotic devices that are remotely controlled by a human operator.

Robotic devices may be commonly used in police and military applications. Systems for mounting firearms on such robotic devices have been developed. As discussed above, these systems for mounting firearms on robotic devices are designed to utilize conventional self-powered weapons. In particular, the weapon, such as a conventional semi-automatic shotgun or an M4 assault rifle, is removably mounted in the system. The conventional system allows a user to wirelessly control actuating mechanisms that perform the typical direct user interface actions, such as releasing the weapon safety switch and pulling the trigger.

Such conventional systems for mounting firearms on robotic devices may have several drawbacks. An enemy can disable the robotic device, remove the firearm from the mounting system, and utilize the firearm against the controller of the robotic device and/or friendly forces. Also, self-powered weapons tend to periodically experience malfunctions, such as misfires. These malfunctions require human interaction and may place the user in a potentially fatal situation. Or, the conventional system may use mechanical devices that simulate the actions taken by a user to correct malfunctions. In either case, the combat availability of the weapon decreases due to the dependence on successful cartridge ignition for mechanical operation. In addition, the placement of a conventional infantry weapon in the mounting system may require a soldier to place his weapon in the mounting system of the robotic device, thereby leaving the soldier personally unarmed during operation of the robotic device.

The use of conventional self-powered weapons in robotic devices may limit the operational capabilities of the armed robotic system due to the intended roles of the individual weapons that are mounted in the devices. That is, a user may choose to place an accurate, semi-automatic assault or sniper rifle on the robot, or a fully-automatic, suppressive fire machine gun on the robot. Each of the guns may be effective for its intended role. But, because of the limited firing rate options of conventional weapons, their effectiveness may be greatly reduced if the firing rate need should change during the combat situation.

SUMMARY OF THE INVENTION

It is an object of the invention to provide a reciprocally-cycled, externally-powered weapon, and a method of operation of the weapon.

It is another object of the invention to provide a reciprocally-cycled, externally-powered weapon that overcomes one or more of the problems of conventional externally-powered weapons.

One aspect of the invention is a reciprocally-cycled, externally-powered weapon that may include a rotative driver connected to one end of a crank, a connecting rod connected at a first end to another end of the crank, a weapon operating group subassembly connected to a second end of the connecting rod, and a receiver. The weapon operating group subassembly may be disposed in the receiver.

The weapon may include a translating rack and a stationary rack, and a pinion in meshing engagement with the translating rack and the stationary rack. The pinion may be operably connected to the second end of the connecting rod. The translating rack may be operably connected to the weapon operating group subassembly. The stationary rack may be fixed to the receiver.

The speed of the rotative driver may be infinitely adjustable between zero speed and a maximum speed. The weapon operating group subassembly may include a firing pin subassembly and an energy generator for the firing pin subassembly. A minimum amount of energy generated by the energy generator may be independent of the translation speed of the operating group subassembly.

Another aspect of the invention is a method that may include providing a reciprocally-cycled, externally-powered weapon. The weapon may be reciprocally cycled using a rotative driver connected to one end of a crank that is operably coupled to an operating group subassembly of the weapon. The method may include generating energy for firing the weapon wherein an amount of energy generated for firing the weapon is independent of a translation speed of an operating group subassembly of the weapon.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

Figure 1:
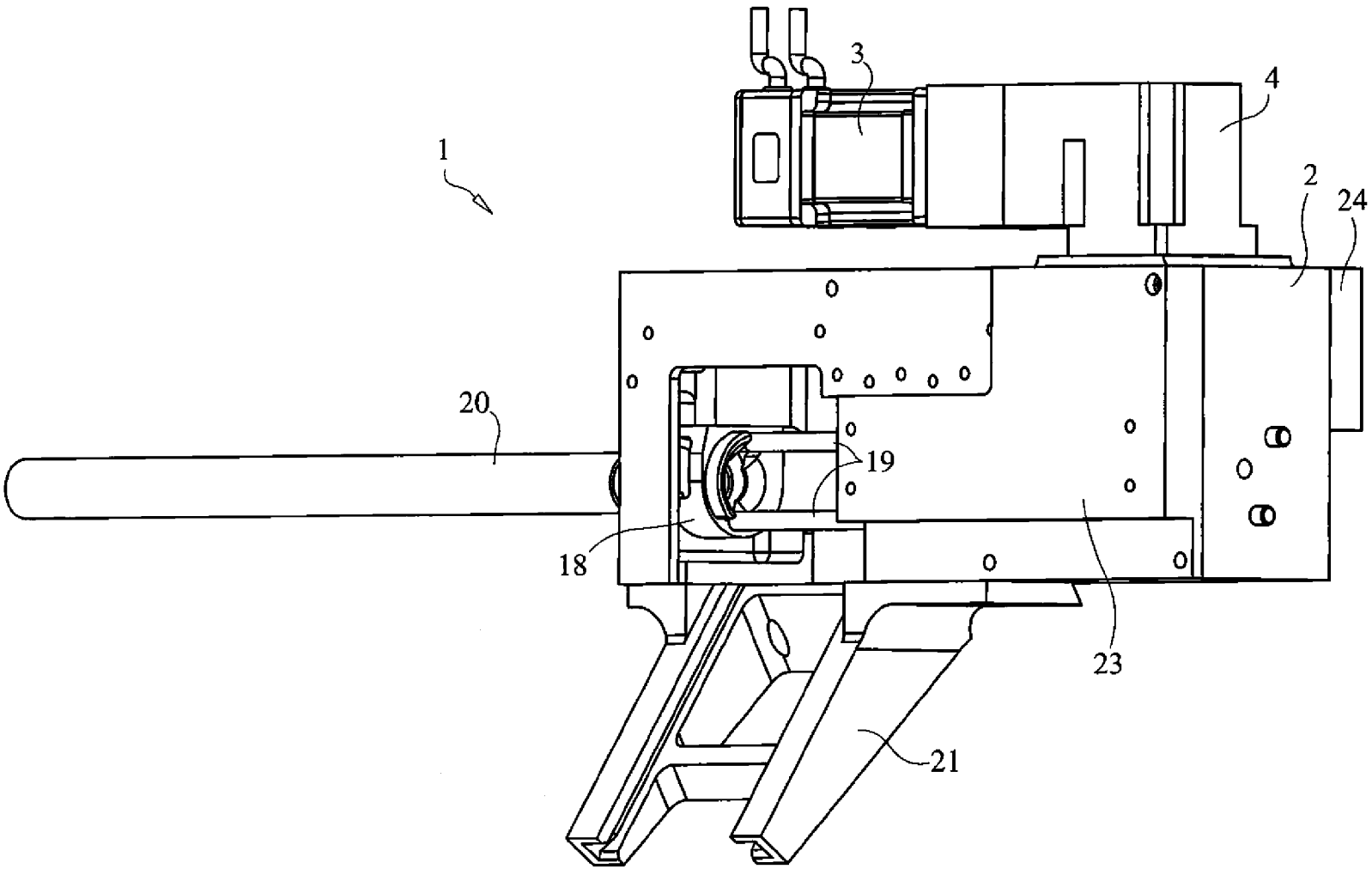
FIG. 1 is a perspective side view of one embodiment of a reciprocally-cycled, externally-operated weapon.

FIG. 1 is a perspective side view of one embodiment of a reciprocally-cycled, externally-operated weapon 1. Weapon 1 may be externally powered by, a rotative driver, such as a motor 3. A gear box 4 may be included, if needed, as a separate component or as an integral part of motor 3. Motor 3 may be selected from many types of motors, including, for example, electric, pneumatic, internal combustion, and others. It is important that the source of power for motor 3 is external to weapon 1. External to weapon 1 means that the motor 3 does not depend on the operation of weapon 1 for its power. For example, motor 3 does not depend on products of combustion or recoil that may be produced by weapon 1.

As shown in FIG. 1, weapon 1 may include a barrel extension 18, a barrel 20, a receiver 2, a right side cover 24, a left side cover 23 and a pair of tubes 19 mounted in receiver 2. A track 21 may be provided to assist in feeding ammunition to weapon 1. Weapon 1 may include several subassemblies. The subassemblies may include a drivetrain subassembly, an operating group subassembly, and a barrel subassembly. The operating group subassembly may include a bolt subassembly and a firing pin subassembly.

Figure 5A:
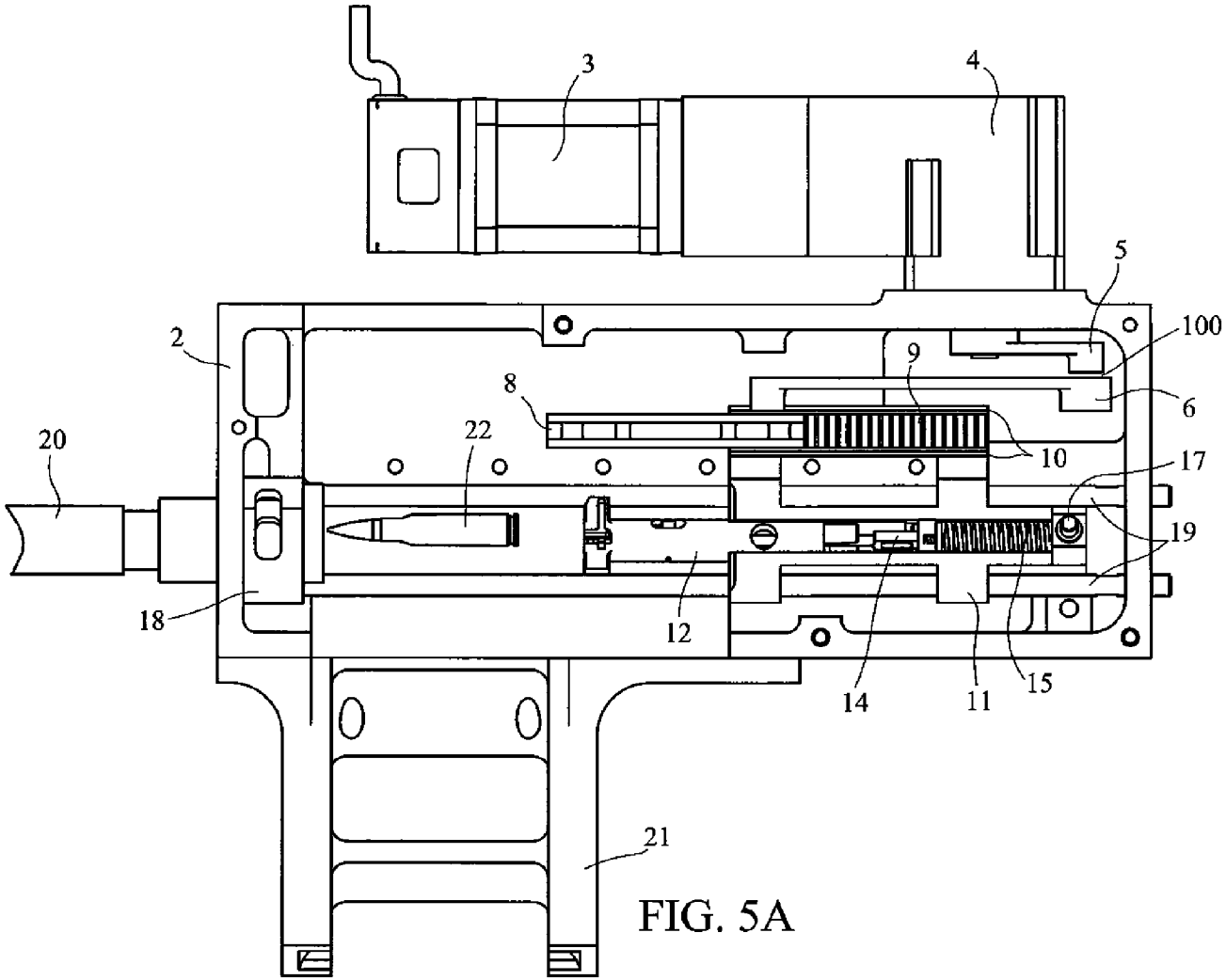
FIG. 5A is a partial side view, partially cut-away.
Figure 5B:
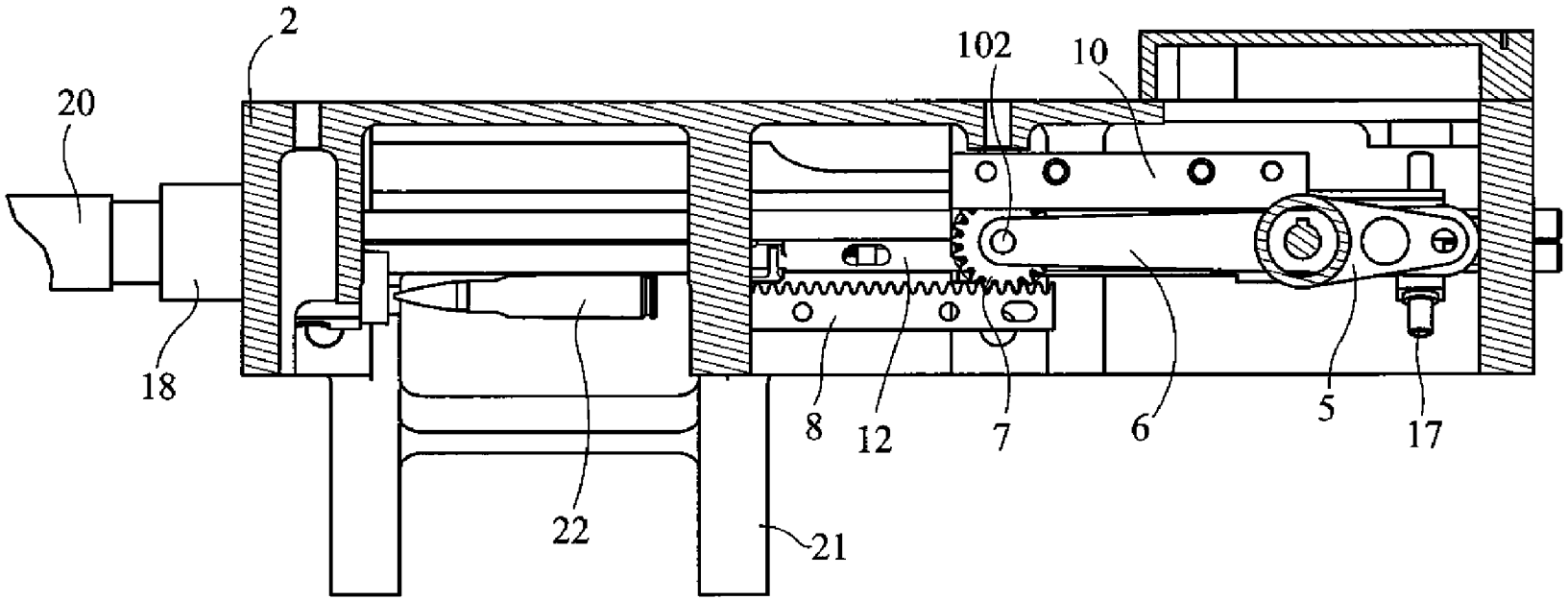
FIG. 5B is a partial top view, in section, showing a first position of the weapon of FIG. 1.

The drivetrain subassembly may provide the energy necessary to cycle the operating group subassembly and complete other operations that may include cartridge stripping, cartridge feeding, cartridge chambering, bolt locking, cartridge firing, bolt unlocking, cartridge case extraction, cartridge case ejection, and, in some embodiments, cartridge indexing. The drivetrain subassembly may be seen, for example, in FIGS. 5A and 5B. FIG. 5A is a partial side view, partially cut-away, and FIG. 5B is a partial top view, in section, showing a first position of the weapon 1 of FIG. 1. The drivetrain subassembly may include a motor 3, a gear box 4, a crank 5, a connecting rod 6, a pinion 7, and a stationary rack 8.

Figure 2A:
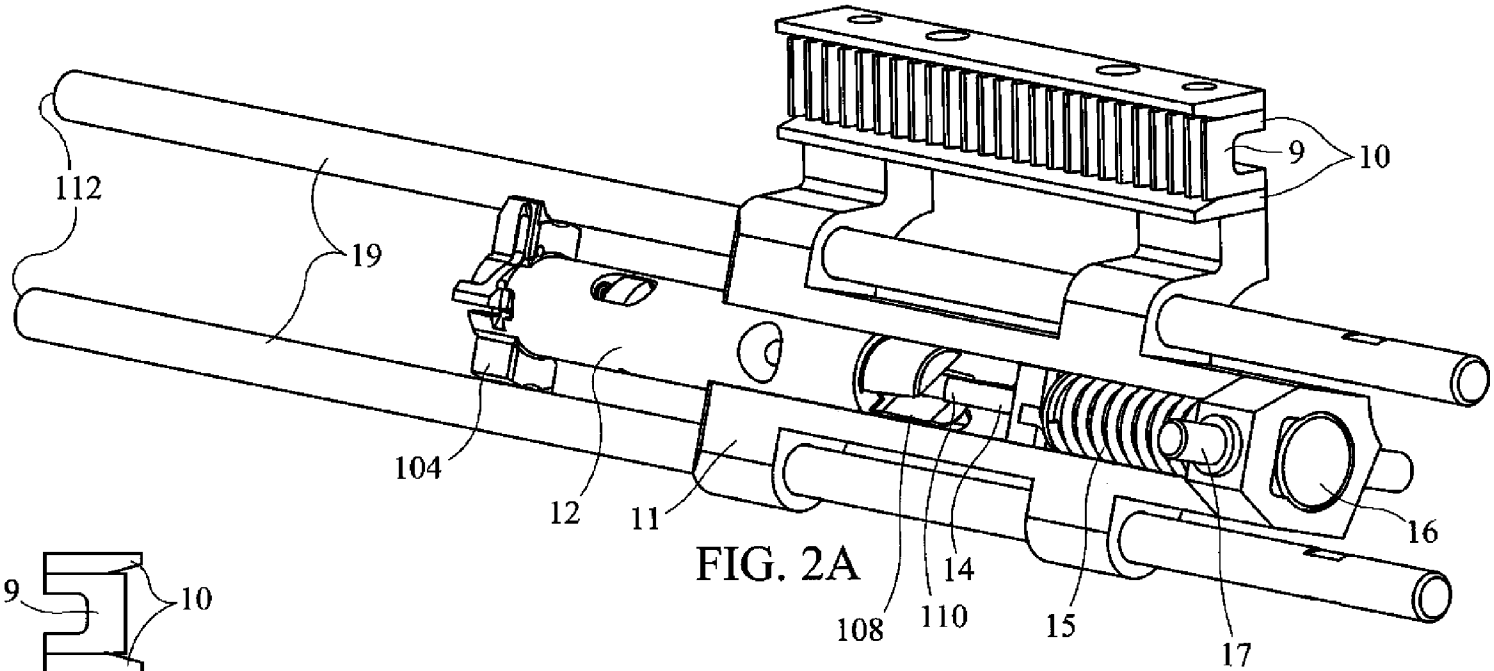
FIGS. 2A, B, C, and D are perspective, front, right side, and left side views, respectively, of an operating group subassembly.
Figure 2B:
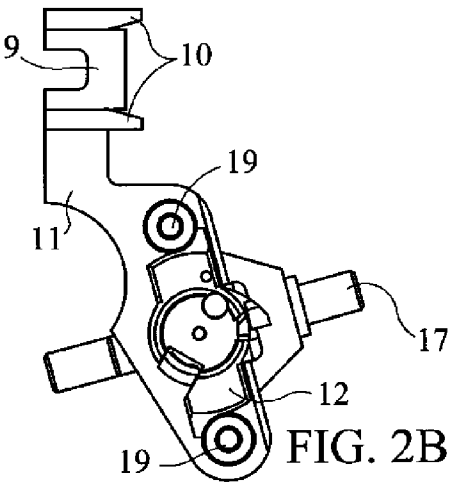

The operating group subassembly may be defined as the internal (within the receiver 2) components (excluding the drivetrain subassembly) that reciprocate throughout the operating cycle of the weapon 1. FIGS. 2A, B, C, and D are perspective, front, right side, and left side views, respectively, of an operating group subassembly. The operating group subassembly may include a bolt carrier 11, pinion guides 10, a translating rack 9, a firing pin subassembly 14, a firing pin drivespring 15, a retaining plug 16, a power take off (PTO) cam pin 17, and a bolt subassembly 12. The bolt carrier 11 may reciprocate in a sliding manner on a bolt carrier support, such as, for example, the tubes 19.

Figure 3C:
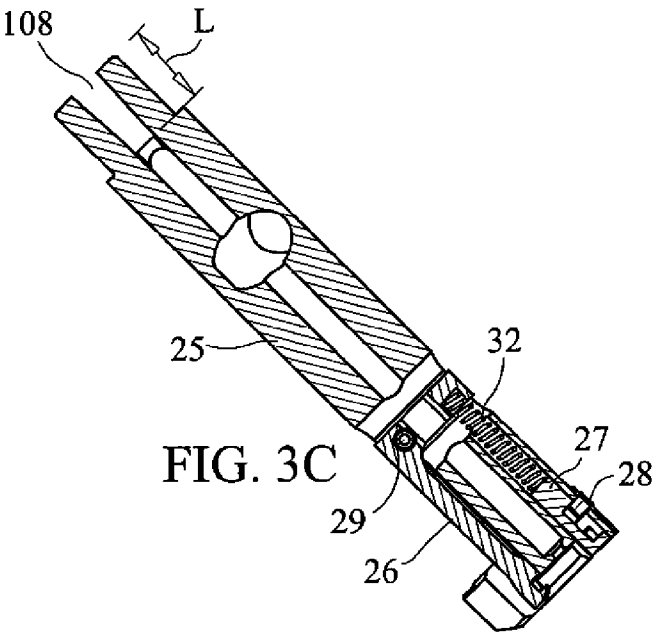
FIG. 3C is a sectional view along the line 3C-3C of FIG. 3B.
Figure 3A:
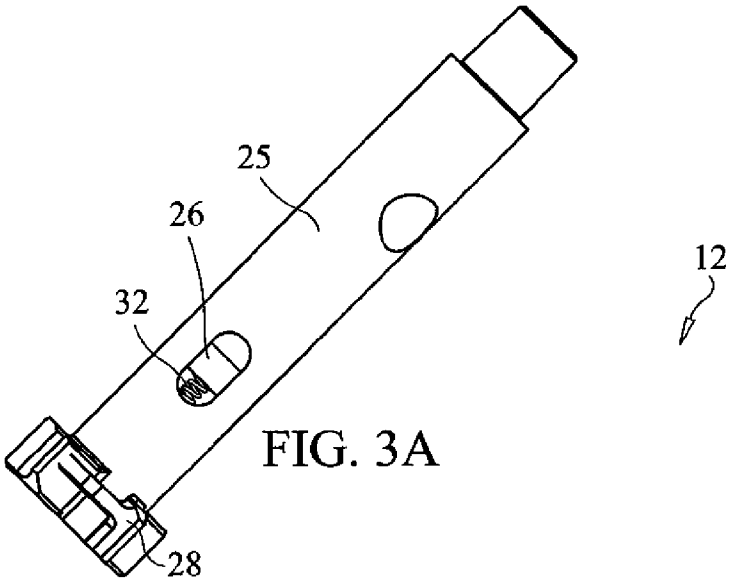
FIGS. 3A and 3B are auxiliary side and front views, respectively, of a bolt subassembly.
Figure 3B:
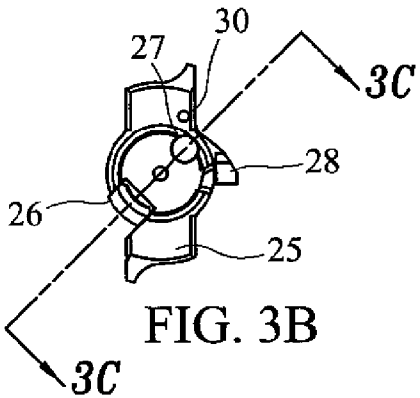

FIGS. 3A and 3B are auxiliary side and front views, respectively, of a bolt subassembly 12, and FIG. 3C is a sectional view of the bolt subassembly 12 taken along the line 3C-3C of FIG. 3B. The bolt subassembly 12 may include a bolt 25, an extractor 26, an extractor pin 29, an extractor/ejector spring 32, a depressible radial rammer 28, a rammer pin 30, a rammer spring, and an ejector 27.

Figure 4:
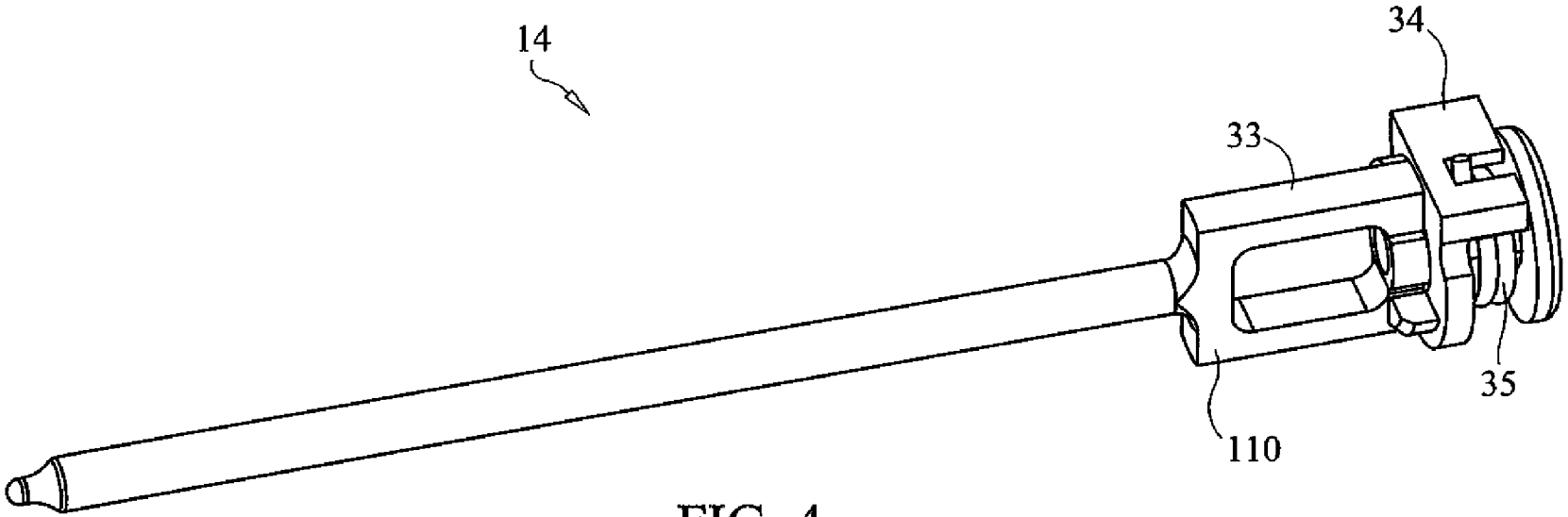
FIG. 4 is a perspective view of a firing pin subassembly 14.

FIG. 4 is a perspective view of a firing pin subassembly 14. The firing pin subassembly may include a firing pin 33, a firing pin base 34, and a torsion spring 35.

The barrel subassembly may include a barrel extension 18 and a barrel 20, as shown, for example, in FIG. 1.

The functional cycle of the weapon 1 may be understood by a description of the components of the weapon 1 as the weapon 1 moves through its functional cycle. FIGS. 5-11 show, respectively, seven functional positions of weapon 1. In each of FIGS. 5-11, the "A" figure shows a partial side view, partially cut-away, of the weapon 1, and the "B" figure shows a partial top view, in section, of the weapon 1.

FIG. 5A is a partial side view, partially cut-away, and FIG. 5B is a partial top view, in section, showing a first position of the weapon 1 of FIG. 1. The functional cycle may begin when the motor 3 transmits torque to the crank 5 via the output shaft of the gear box 4. The crank 5 and the output shaft of the gear box 4 may be rigidly coupled using, for example, a key and keyway, interference fit, friction collar, set screw, or other means. The crank 5 may be pinned to the connecting rod 6 at location 100 (FIG. 5A) using, for example, a shoulder screw, pin, or other means. The opposite end of the connecting rod 6 may be coupled to the pinion 7 at location 102 (FIG. 5B) using, for example, a shoulder screw, pin, or other means. The pinion 7 may engage both the stationary rack 8 and the translating rack 9. The translating rack 9 may be rigidly coupled to the bolt carrier 11 to thereby move with the bolt carrier 11.

The output motion of the bolt carrier 11 resulting from the rotation of the crank 5 is a combination of the kinematics of the crank 5 and the connecting rod 6, along with the stroke multiplying effect caused by the interaction of the translating rack 9, the pinion 7, and the stationary rack 8. The geared engagement between the teeth of the rotating pinion 7, the stationary rack 8, and the translating rack 9 may allow for a desirable two-to-one multiplying effect, compared to the stroke length associated with using only a connecting rod and crank linkage arrangement. The pinion guides 10 may constrain the vertical movement of the pinion 7 as the pinion 7 rotates and translates throughout the cycle.

Figure 6A:
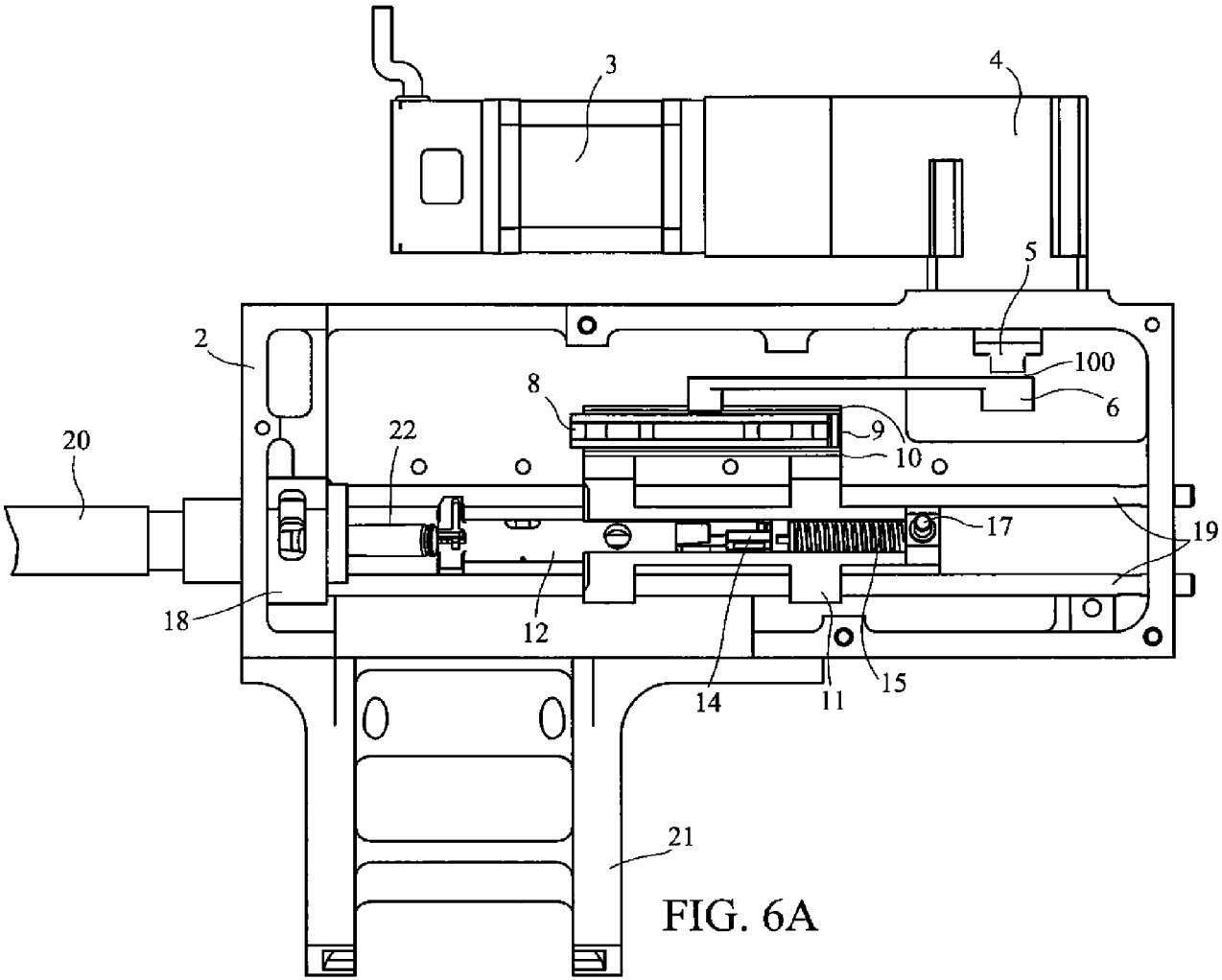
FIG. 6A is a partial side view, partially cut-away.
Figure 6B:
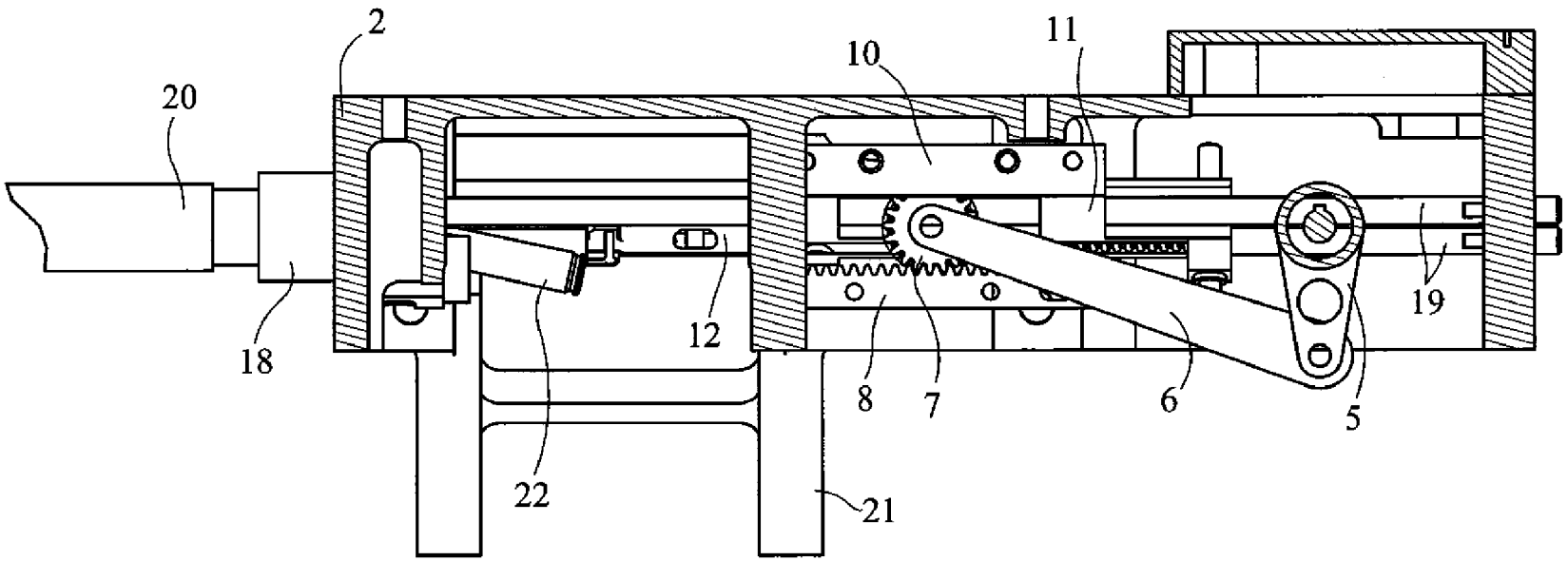
FIG. 6B is a partial top view, in section, showing a second position of the weapon of FIG. 1.

FIG. 6A is a partial side view, partially cut-away, and FIG. 6B is a partial top view, in section, showing a second position of the weapon 1 of FIG. 1. The second position of FIGS. 6A and 6B illustrates the locations of the internal components of the weapon 1 after the crank 5 rotates ninety degrees from the first position, shown in FIGS. 5A and 5B. At this point, as well as any point throughout the cycle, the operating group subassembly has traveled a distance twice that of the distance traveled by the pinion 7 and the end of the connecting rod 6 connected to the pinion 7.

During translation of the operating group subassembly, the bolt carrier 11 may be supported by and may slidably reciprocate on two tubes 19. In the illustrated embodiment, tubes 19 may be cylindrical in shape. Translation of the bolt subassembly 12, as well as angular position control of the bolt subassembly 12, may be facilitated by the tubes 19. Other methods may also be used to support the bolt carrier 11 and control the angular position of the bolt subassembly 12. For example, the receiver 2 may be fabricated with integral features that support the bolt carrier 11 and control the angular position of the bolt subassembly 12.

At this point in the cycle, the bolt subassembly 12 reaches a point where it begins to strip a cartridge 22 from the ammunition supply and feed it into the barrel extension 18 towards the chamber of the barrel 20. Stripping of cartridge 22 may be accomplished by means of the depressible radial rammer 28, which may pivot about the rammer pin 30 (FIGS. 3A-C). For most of the cycle, the depressible radial rammer 28 may remain in its stripping (non-depressed) position relative to the bolt 25, due to the restorative force of the rammer spring.

Depending on the particular application, the ammunition supply may or may not be mechanically linked and/or controlled by the PTO cam pin 17, which may be rigidly coupled to the bolt carrier 11 (FIG. 2A). For example, the PTO cam pin 17 may engage a cam slot in a feed cover designed to manipulate a linked belt of ammunition (such as those typically used in the M249 and M240 machine guns), or the PTO cam pin 17 may engage a cylindrical cam that indexes a feed sprocket (such as those used in the XM235 Rodman Squad Automatic Weapon). In other embodiments, the ammunition supply may be self-regulating/controlling, such as a spring-fed stacked magazine, similar to those used in the M16/M4 series of assault rifles. In other embodiments, additional and other unique ammunition supply mechanisms may be utilized. For certain ammunition sources, the track 21 (FIG. 1) may be utilized for securing the ammunition supply and/or controlling the presented cartridges 22.

Figure 2C:
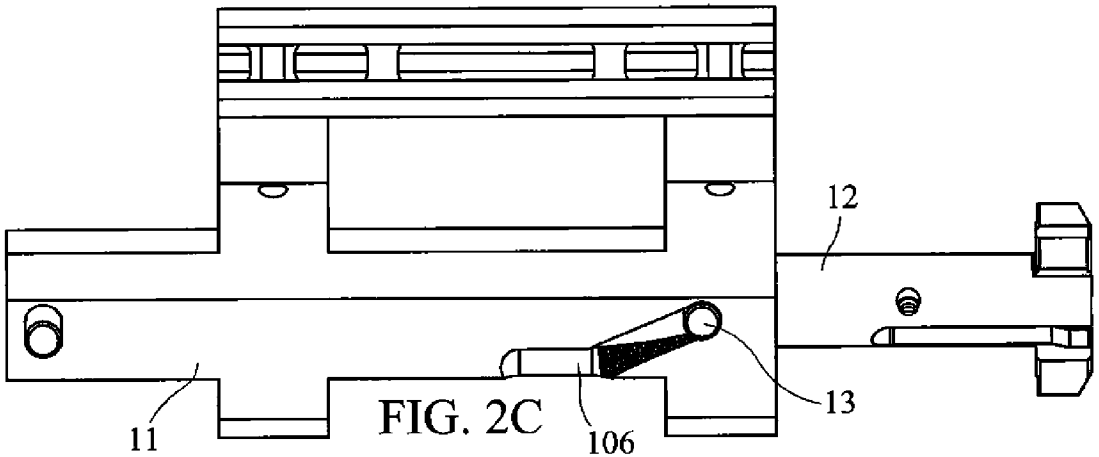
Figure 7A:
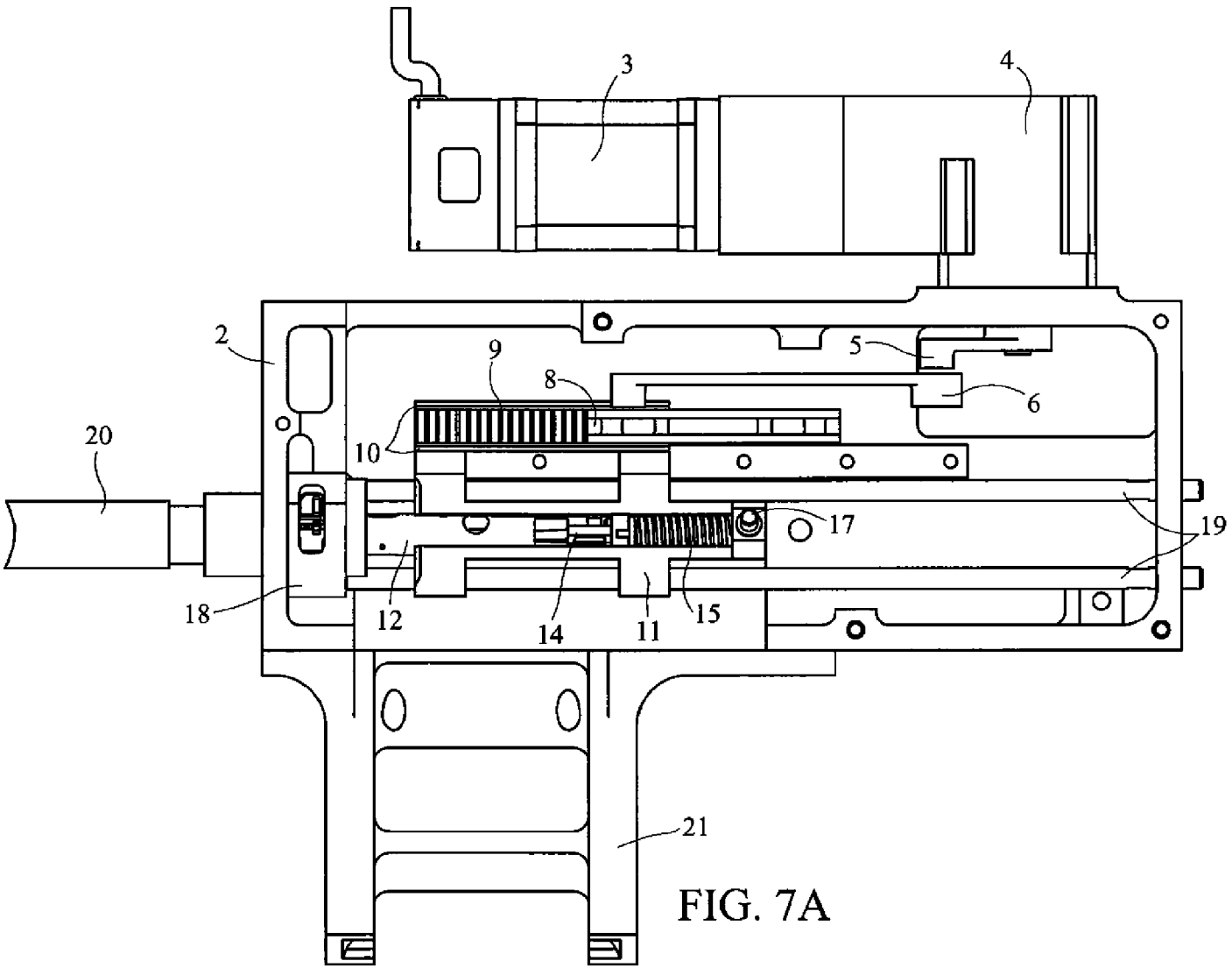
FIG. 7A is a partial side view, partially cut-away.
Figure 7B:
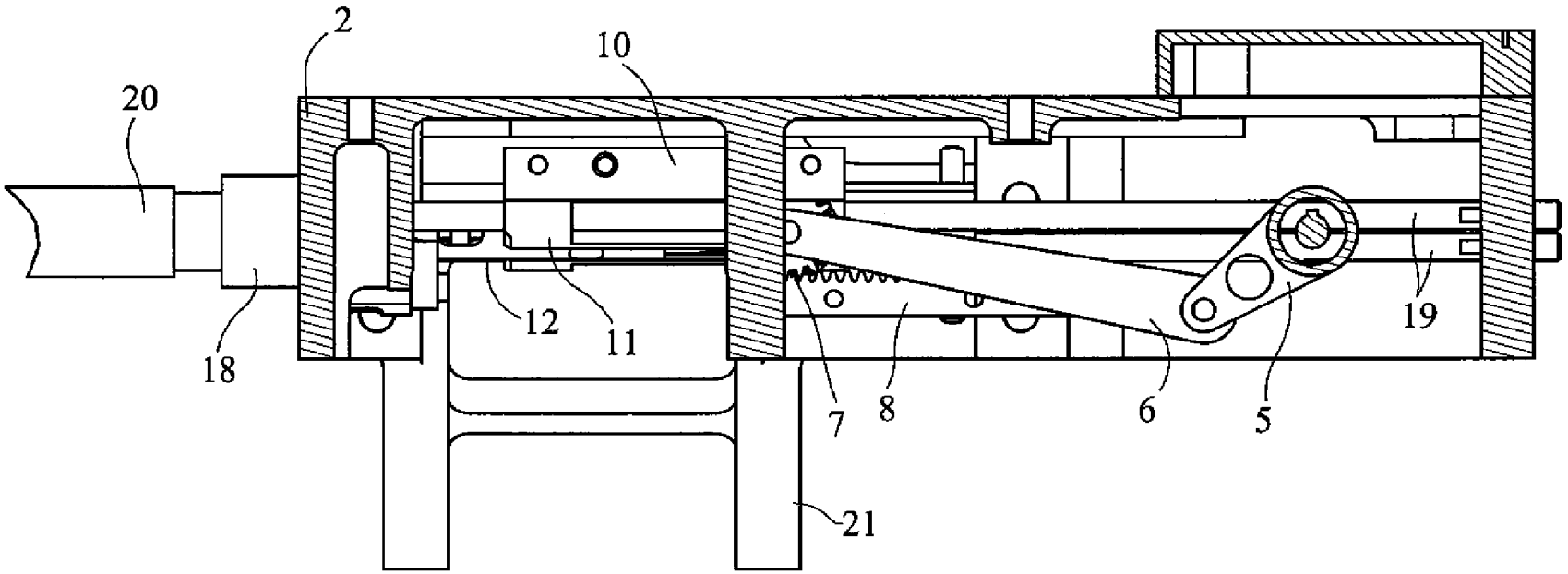
FIG. 7B is a partial top view, in section, showing a third position of the weapon of FIG. 1.

Further crank 5 rotation from the second position of FIGS. 6A and 6B results in additional forward translation of the operating group subassembly to the third position shown in FIGS. 7A and 7B. FIG. 7A is a partial side view, partially cut-away, and FIG. 7B is a partial top view, in section, showing the third position of the weapon 1 of FIG. 1. At this point the chambering of cartridge 22 is complete. Translation of the bolt subassembly 12 ceases, but the bolt subassembly 12 is rotating relative to the bolt carrier 11. This rotation of the bolt subassembly 12 relative to the bolt carrier 11 is possible only after the cartridge 22 is fully chambered and the front 104 (FIG. 2A) of the bolt subassembly 12 clears the front 112 of the tubes 19. Once clear of the tubes 19, the angular position of the bolt subassembly 12 is no longer restricted. The bolt cam pin 13 (FIG. 2C) may engage a cam slot 106 in the bolt carrier 11, which in turns facilitates the intended rotation of the bolt subassembly 12.

At this point, the front of the bolt subassembly 12 resides within an internal pocket of the barrel extension 18. As the bolt subassembly 12 rotates, the locking surfaces of the bolt 25 overlap the corresponding locking surfaces of the barrel extension 18. This process, commonly referred to as bolt locking, supports the firing event of the cartridge 22 and decouples the reaction forces associated with the firing event from the other components of the operating group subassembly and the drivetrain subassembly.

While the bolt subassembly 12 is no longer moving forward, the bolt carrier 11 is still undergoing forward translation. The relative movement between the bolt subassembly 12 and bolt carrier 11 allows the firing pin drivespring 15 to further compress. Further compression of the firing pin drivespring 15 generates the potential energy necessary to propel the firing pin subassembly 14 forward and initiate ignition of the cartridge 22, which occurs a bit later in the cycle. The firing pin drivespring 15 may function as an energy generator to supply the energy needed to propel the firing pin subassembly 14 toward the cartridge 22.

At this point in the cycle, the ejector 27 (FIGS. 3B and C) is fully depressed and further compresses the extractor/ejector spring 32. The extractor 26 has also rotated about the extractor pin 29 until the extractor 26 sits over the rim of the case of the cartridge 22.

Figure 8A:
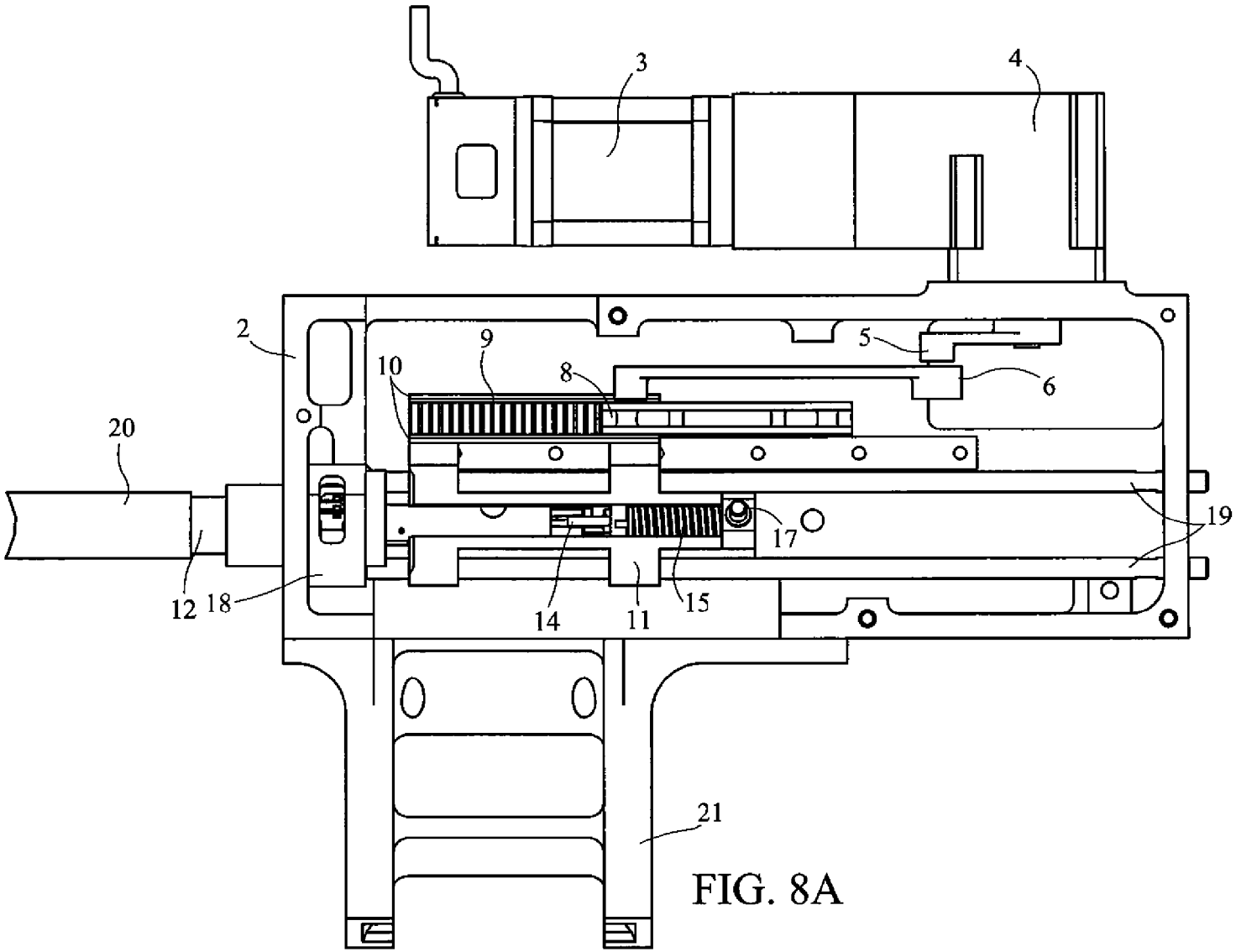
FIG. 8A is a partial side view, partially cut-away.
Figure 8B:
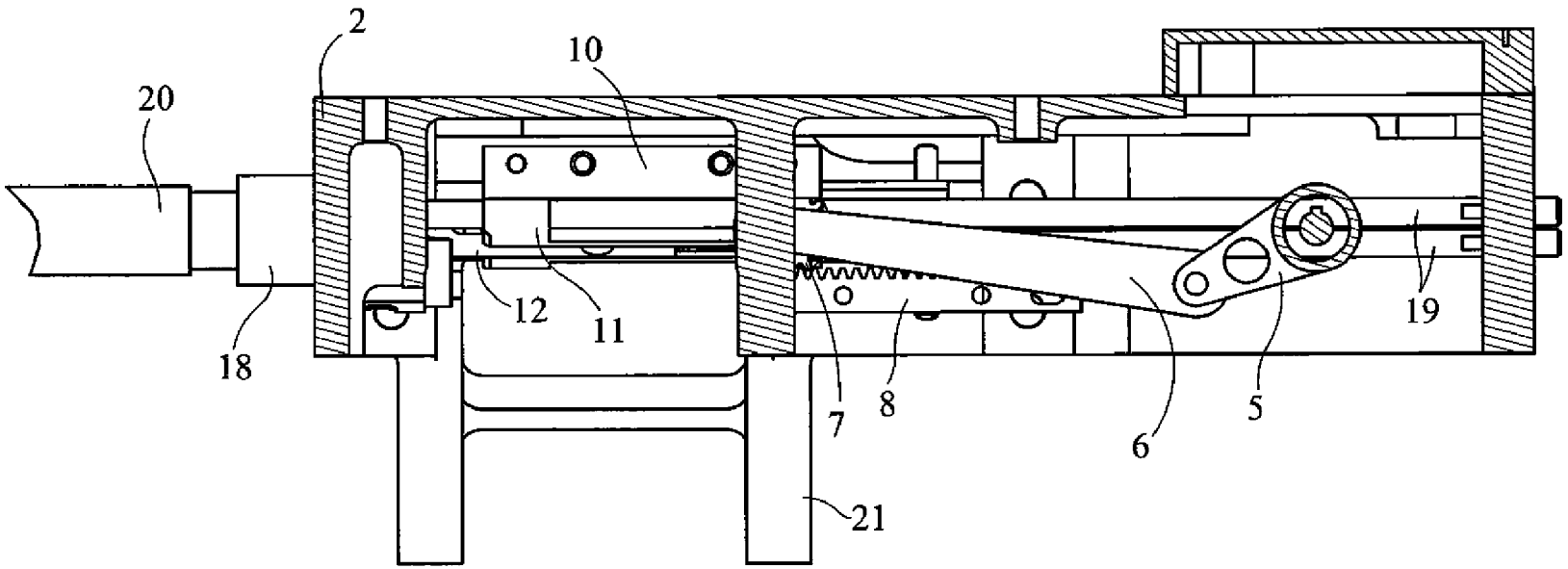
FIG. 8B is a partial top view, in section, showing a fourth position of the weapon of FIG. 1.

FIG. 8A is a partial side view, partially cut-away, and FIG. 8B is a partial top view, in section, showing a fourth position of the weapon 1 of FIG. 1. In the fourth position of the cycle, the bolt subassembly 12 has completed its angular rotation. The locking surfaces of the bolt 25 are fully engaged with those of the barrel extension 18. As soon as the bolt subassembly 12 reaches its fully rotated and locked position, a slot 108 (FIGS. 2A and 3C) in the rear of the bolt 25 becomes aligned with an engaging feature 110 (FIGS. 2A and 4) on the firing pin 33. The firing pin subassembly 14 is thereby free to move forward a distance equal to the length L (FIG. 3C) of the slot 108 in the rear of the bolt 25.

The forward movement of the firing pin subassembly 14 over the distance L is powered by the potential energy stored in the firing pin drivespring 15. The firing pin drivespring 15 extends from its compressed state to generate the velocity and associated kinetic energy of the firing pin subassembly 14 that is necessary for successful ignition of cartridge 22. The moment when the slot 108 in the rear of the bolt 25 becomes aligned with the engaging feature 110 on the firing pin 33 is analogous to "pulling the trigger" on a weapon that has a trigger. At that moment, an event has been triggered that will result in the firing pin 33 being propelled forward toward the primer of the cartridge 22, with the intent of firing the cartridge 22.

Figure 9A:
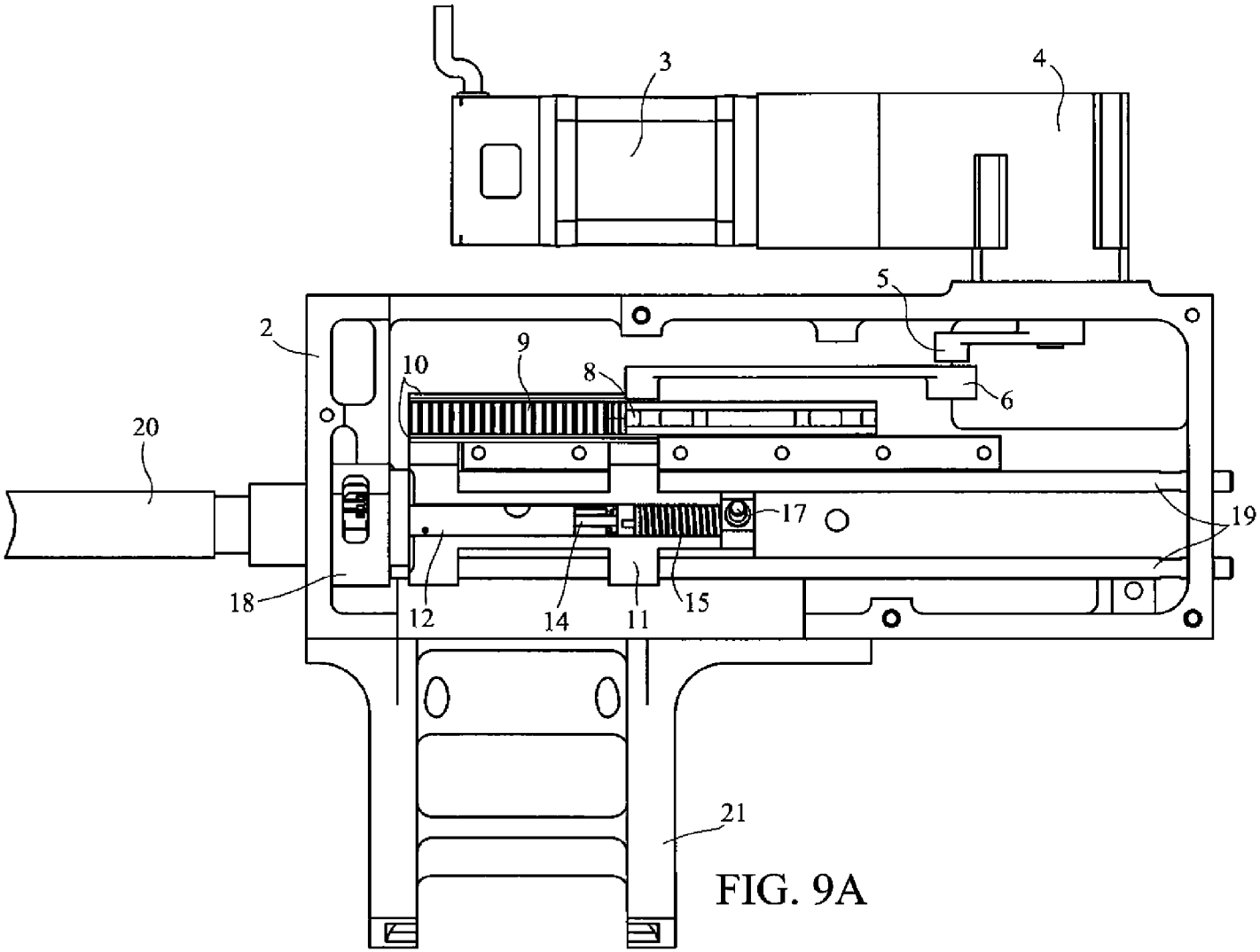
FIG. 9A is a partial side view, partially cut-away.
Figure 9B:
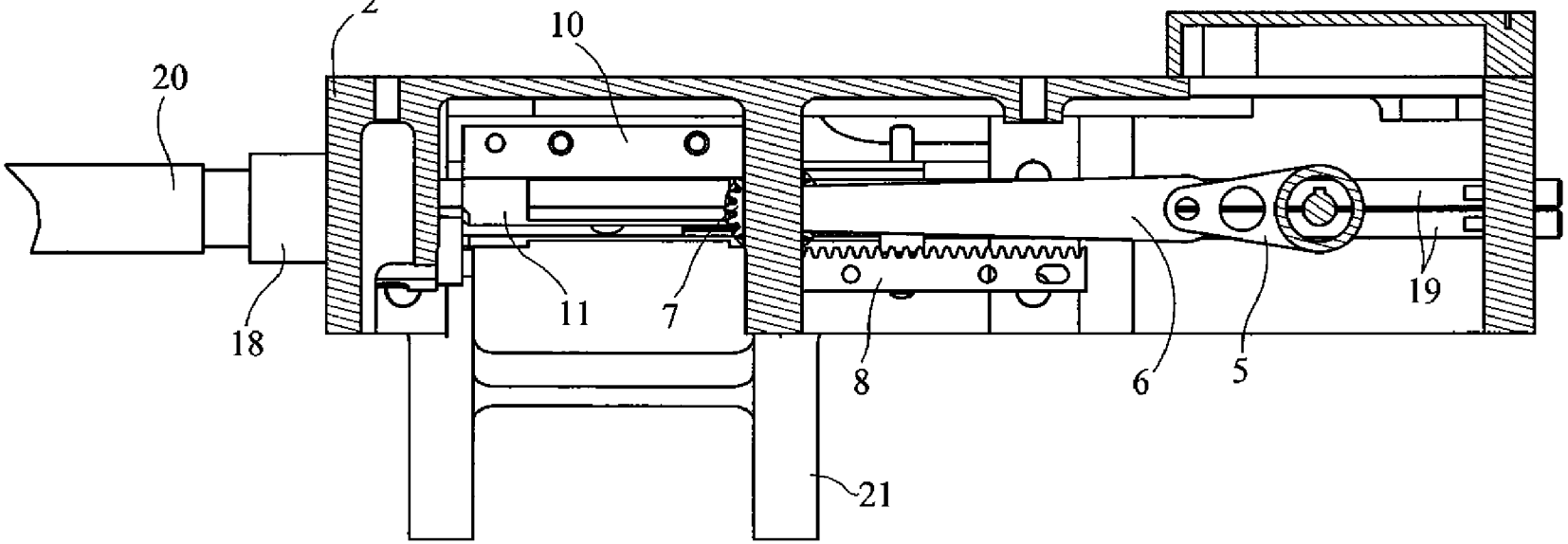
FIG. 9B is a partial top view, in section, showing a fifth position of the weapon of FIG. 1.

FIG. 9A is a partial side view, partially cut-away, and FIG. 9B is a partial top view, in section, showing a fifth position of the weapon 1 of FIG. 1. The fifth position represents the end of the counterrecoil portion of the cycle and the beginning of the recoil portion of the cycle. The operating group and drivetrain subassemblies have zero instantaneous velocity at this point. Firing of the cartridge 22 has taken place at or slightly before this position, depending on the chosen rate of fire. At certain firing rates the bolt carrier 11 may still be moving forward when the cartridge 22 is fired. The firing pin subassembly 14 has traveled a forward distance, relative to the bolt subassembly 12, equal to the length L of the slot 108 in the rear of the bolt 25. This distance permits the firing pin drivespring 15 to generate sufficient velocity and energy such that the firing event is initiated when the tip of the firing pin 33 strikes the primer of the cartridge 22.

Successful ignition of the cartridge 22 is dependent only on the associated velocity and kinetic energy of the firing pin subassembly 14 and does not rely on any generated momentum associated with the rest of the operating group subassembly. The lack of dependence on the movement of any other components of the operating group subassembly is important because the design of the firing mechanism, in conjunction with the ability to vary the speed of the motor 3, allows for infinite adjustment of the firing rate. The minimum amount of energy produced by the firing pin energy generator, which is the firing pin drivespring 15 in the disclosed embodiment, may be independent of the translation speed of the operating group subassembly and sufficient to ensure successful ignition of cartridge 22. Thus, the firing rate may be infinitely adjusted from zero rounds per minute up to the designed mechanical limitation, which may be on the order of several hundred rounds per minute or greater.

Another advantage of the independence of the firing pin energy generator from the momentum associated with the rest of the operating group subassembly is, for example, when weapon 1 must be fired as accurate as possible, to engage point targets. In that case, movement of the operating group subassembly may adversely affect the accuracy of weapon 1. But, the minimum energy available from the firing pin drivespring 15 will result in successful ignition of cartridge 22 regardless of the speed of the other components comprising the operating group subassembly. Therefore, the operating group subassembly may be positioned such that the slot 108 in the rear of the bolt 25 is very nearly aligned with the engaging feature 110 on the firing pin 33. Then, the weapon 1 may be aimed. When ready to fire, the bolt carrier 11 may be very slowly advanced only the miniscule amount necessary to complete rotation of the bolt subassembly 12 and align the slot 108 of the bolt 25 with the engaging feature 110 of the firing pin 33. When the slot 108 of the bolt 25 is aligned with the engaging feature 110 of the firing pin 33, the firing pin subassembly 14 is driven forward and the weapon 1 fires. In this manner, any inaccuracy of the weapon 1 that may be caused by movement of the components within weapon 1 may be minimized.

An additional benefit of weapon 1 is that the designed overtravel in the bolt carrier 11, in combination with the control of the release of the firing pin subassembly 14 by the angular position of the bolt subassembly 12, allows for advanced ignition of the cartridge 22 (relative to the bolt carrier 11 position). Advanced ignition of the cartridge 22 may occur while the bolt 25 is fully rotated and locked, even though the bolt carrier 11 may still be moving forward during counterrecoil. This feature allows for additional lock time of the bolt 25 to help mitigate hangfires of the cartridge 22, which may be problematic for certain conventional externally-actuated weapon mechanisms.

Figure 2D:
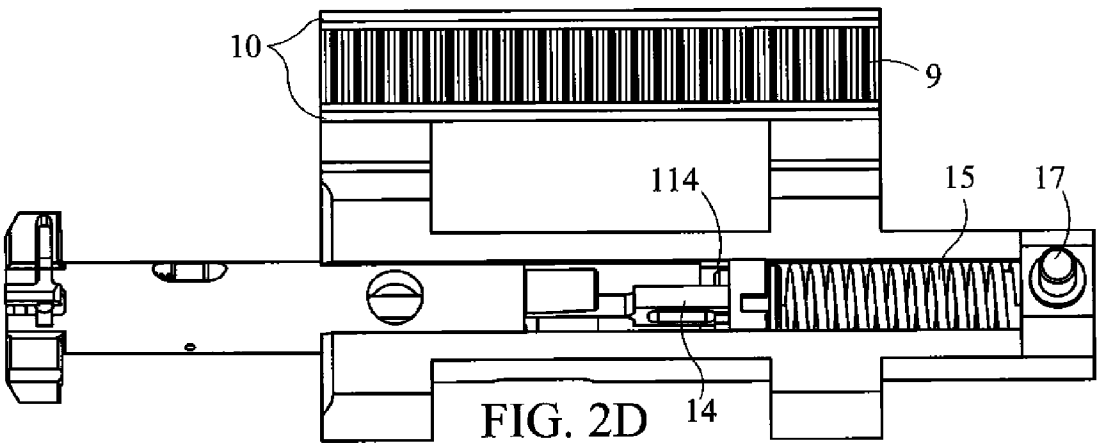
Figure 10A:
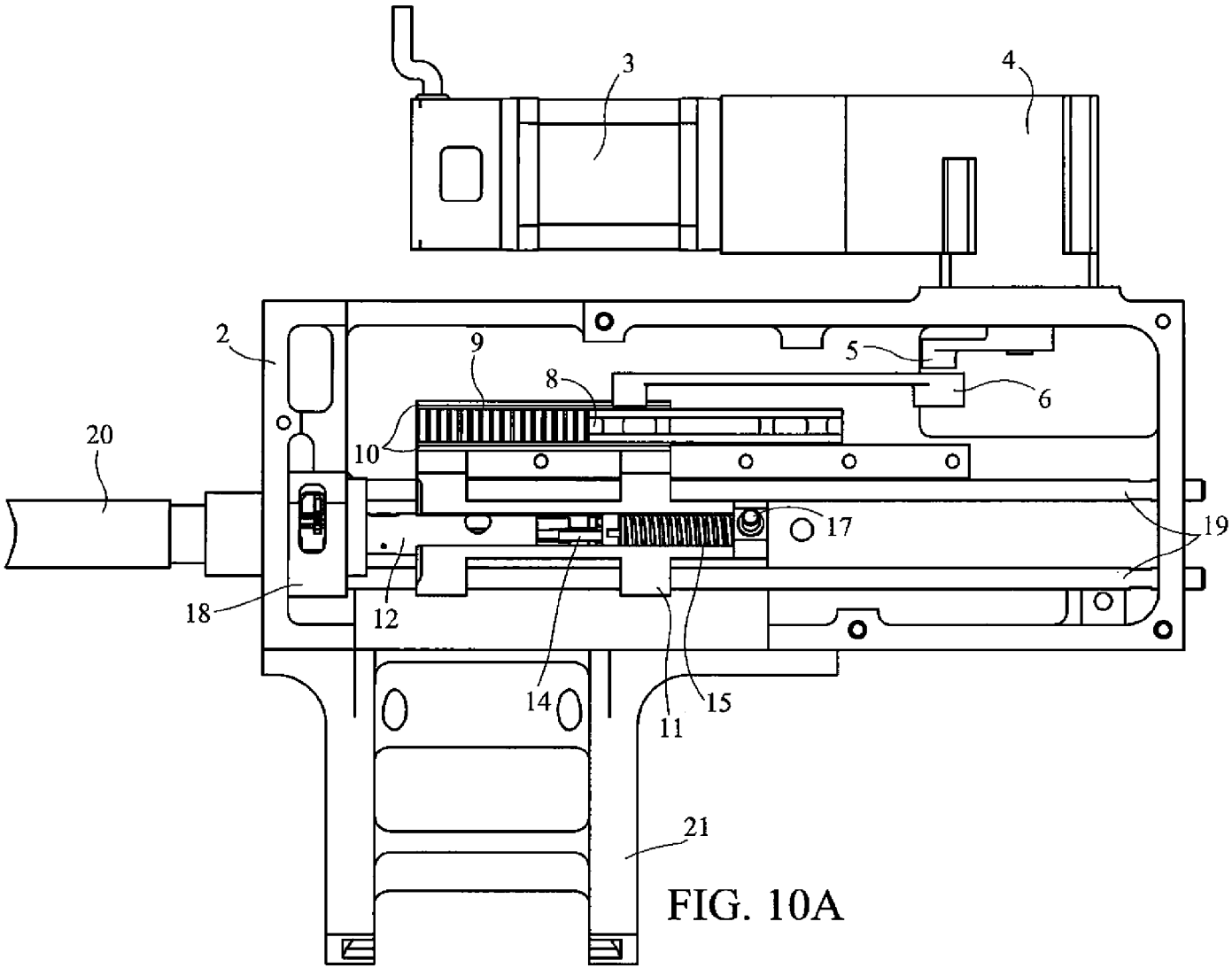
FIG. 10A is a partial side view, partially cut-away.
Figure 10B:
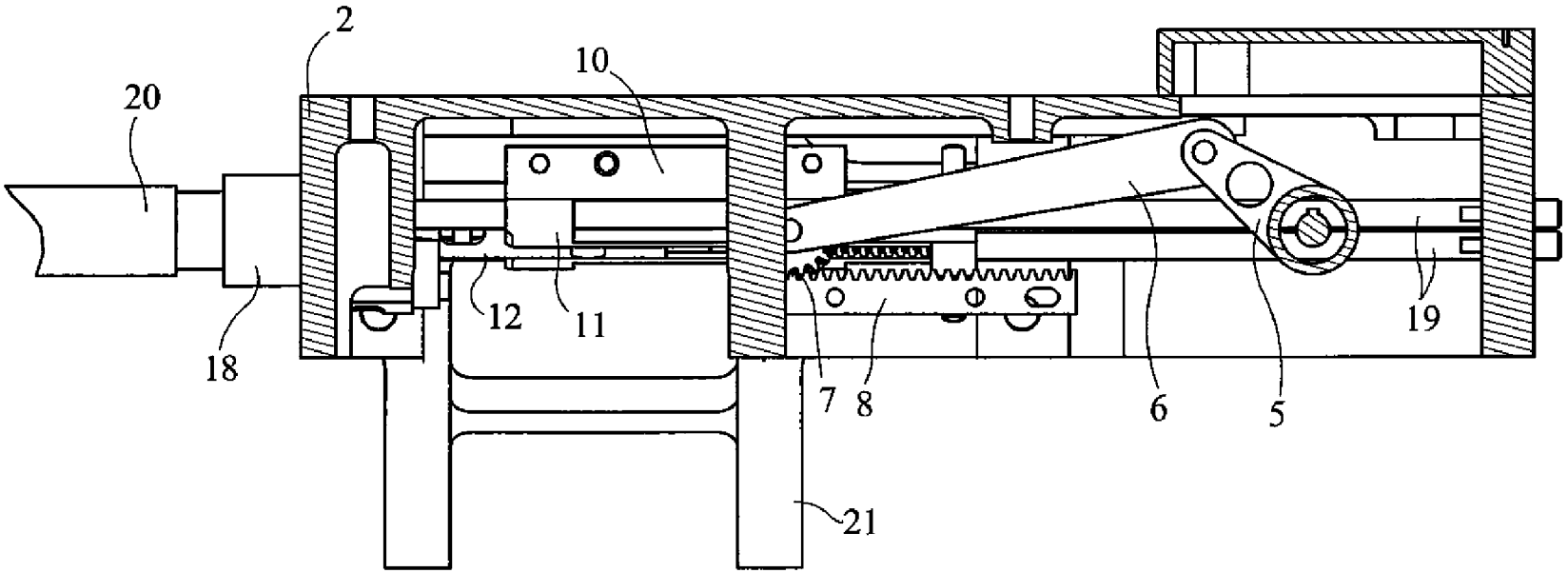
FIG. 10B is a partial top view, in section, showing a sixth position of the weapon of FIG. 1.

FIG. 10A is a partial side view, partially cut-away, and FIG. 10B is a partial top view, in section, showing a sixth position of the weapon 1 of FIG. 1. The sixth position illustrates a position early in the recoil portion of the cycle when the bolt carrier 11 begins moving to the rear. At this point, the bolt subassembly 12 is not yet translating, but is undergoing rotation via the bolt cam pin 13, to unlock itself from the barrel extension 18. At the same time, the bolt carrier 11 is already moving rearward, and a shoulder 114 (FIG. 2D) internal to the bore of the bolt carrier 11 engages the firing pin base 34, thereby retracting the entire firing pin subassembly 14, in order to reset the firing pin subassembly 14 for the next cycle.

While the bolt subassembly 12 undergoes the process of unlocking, the firing pin 33 is being retracted from the slot 108 in the rear of the bolt 25. The firing pin 33 rotates with the bolt subassembly 12 and rotates relative to the firing pin base 34 (FIG. 4). The firing pin base 34 is only able to translate (and not rotate) within the bolt carrier 11. After the firing pin 33 clears the slot in the rear of the bolt 25, the torsion spring 35 acts to reset the firing pin 33 to its original angular position, relative to the firing pin base 34, at the beginning of the cycle. This action may be completed prior to completion of the unlocking of the bolt subassembly 12. When the bolt subassembly 12 is completely unlocked, the bolt subassembly 12 may translate along with the bolt carrier 11 and the remainder of the operating group subassembly.

Throughout the unlocking process of the bolt subassembly 12, the ejector 27 (FIGS. 3B and C) remains fully compressed and the extractor 26 rotates about the rim case of the cartridge 22. In certain embodiments with particular ammunition handling mechanisms, it is also possible that the PTO cam pin 17 may start to engage any number of ammunition indexing mechanisms to control the movement and presentation of subsequent cartridges 22.

Figure 11A:
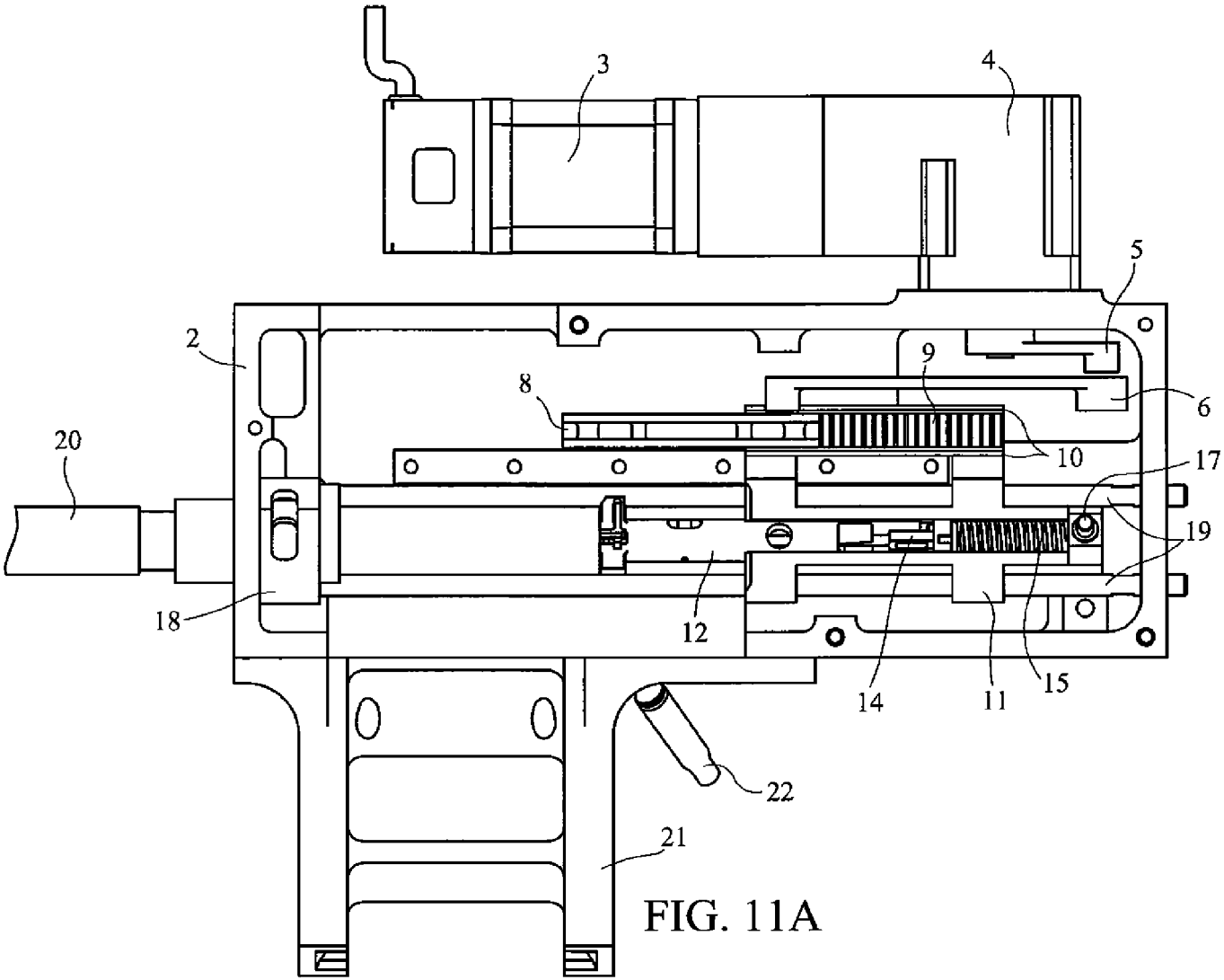
FIG. 11A is a partial side view, partially cut-away.
Figure 11B:
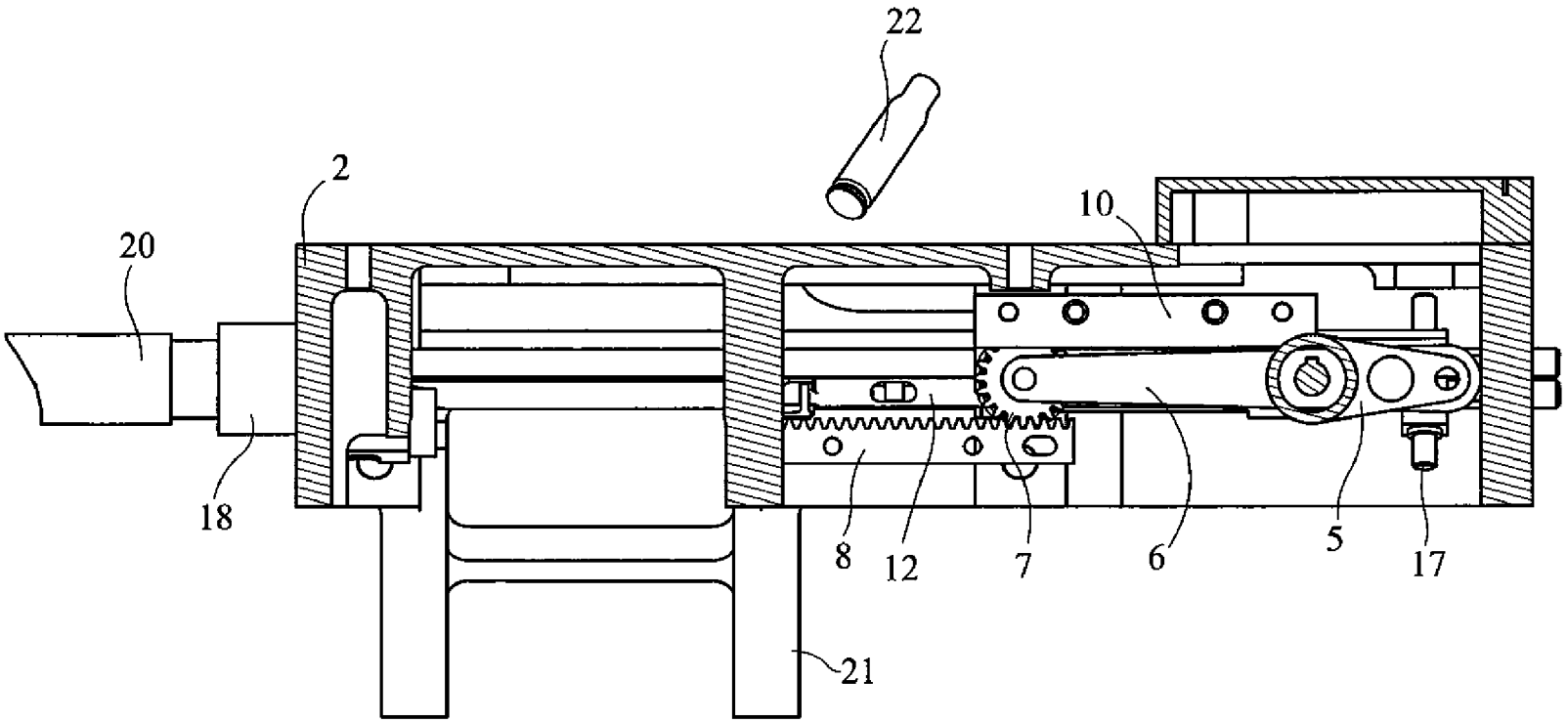
FIG. 11B is a partial top view, in section, showing a seventh position of the weapon of FIG. 1.

FIG. 11A is a partial side view, partially cut-away, and FIG. 11B is a partial top view, in section, showing a seventh position of the weapon 1 of FIG. 1. The seventh position illustrates ejection of the empty case of cartridge 22. After the bolt subassembly 12 is fully unlocked and begins its movement rearward, the extractor 26 (FIGS. 3A-C) pulls the empty case of cartridge 22 from the chamber of the barrel 20. The previously compressed extractor/ejector spring 32 pushes the ejector 27 out of the face of the bolt 25, until the motion of the ejector 27 is stopped by the rear surface of the depressible radial rammer 28. As the ejector 27 moves out of the face of bolt 25, it imparts an impulsive force on the head of the empty case of cartridge 22. This impulsive force causes the case of cartridge 22 to rotate about the extractor 26 until there is no longer any surface contact, at which point the case of cartridge 22 is propelled away from the receiver 2.

In some embodiments using certain types of ammunition handling mechanisms, as the operating group subassembly passes from the sixth position to the seventh position, the depressible radial rammer 28 rotates inward about the rammer pin 30 towards the axis of the bolt 25. This action is intended and may be advantageous if the cartridge 22 that is moving into the feed position for the next cycle interferes with the path swept by the depressible radial rammer 28, in its non-depressed position. Once the depressible radial rammer 28 is free to return to its non-depressed position, a rammer spring may provide the necessary restoring force.

While the invention has been described with reference to certain preferred embodiments, numerous changes, alterations and modifications to the described embodiments are possible without departing from the spirit and scope of the invention as defined in the appended claims, and equivalents thereof. For example, a drivetrain subassembly may include a connecting rod that is directly connected to the operating group subassembly, without the use of a pinion, stationary rack, or translating rack. In that case, the crank of a drivetrain subassembly that does not include a pinion and a stationary rack may need to be twice as long as the crank 5 in weapon 1 shown in the Figs., to produce the same amount of resultant operating group subassembly translation.

What is claimed is:

1. A reciprocally-cycled, externally-powered weapon, comprising:

a rotative driver connected to one end of a crank;

a connecting rod connected at a first end to another end of the crank;

a weapon operating group subassembly connected to a second end of the connecting rod; and a receiver, the weapon operating group subassembly being disposed in the receiver, further comprising a translating rack and a stationary rack, and a pinion in meshing engagement with the translating rack and the stationary rack, the pinion being operably connected to the second end of the connecting rod, the translating rack being operably connected to the weapon operating group subassembly, and the stationary rack being fixed to the receiver, wherein the weapon operating group subassembly includes a bolt carrier fixed to the translating rack, a firing pin subassembly disposed in the bolt carrier, and a bolt subassembly disposed in the bolt carrier, wherein the bolt subassembly is rotatable with respect to the bolt carrier, wherein the bolt subassembly includes a bolt and the firing pin subassembly includes a firing pin, the bolt being rotatable with respect to the firing pin, wherein the bolt includes a rearward end having a slot formed therein and the firing pin includes an engaging member for engaging the slot in the bolt, wherein the firing pin subassembly includes a firing pin base, the firing pin being rotatable with respect to the firing pin base, wherein the firing pin subassembly includes a torsion spring for applying a rotative force on the firing pin.

* * * * *